US005244115A

United States Patent [19]

Huck

[11] Patent Number: 5,244,115

[45] Date of Patent: Sep. 14, 1993

[54] PAPER SLIP STORAGE AND DISPENSING APPARATUS

[76] Inventor: Joel C. Huck, P.O. Box 42230, Houston, Tex. 77242

[21] Appl. No.: 878,415

[22] Filed: May 4, 1992

[51] Int. Cl.[5] ..... B65H 1/08

[52] U.S. Cl. ..... 221/231; 221/124; 221/131; 221/236; 221/244; 221/259

[58] Field of Search ..... 221/124, 131, 154, 231, 221/236, 244, 247, 259, 281

[56] References Cited

U.S. PATENT DOCUMENTS

| | | | |
|---|---|---|---|
| 1,043,052 | 10/1912 | Otter | 221/131 |
| 1,105,679 | 8/1914 | McLane | 221/131 |
| 1,395,857 | 11/1921 | Matthews | 221/131 |
| 1,461,332 | 7/1923 | Schoepe | 221/154 |
| 1,680,275 | 8/1928 | Albaugh | 221/131 |
| 3,276,457 | 10/1966 | Edds | 221/154 X |

FOREIGN PATENT DOCUMENTS

| | | | |
|---|---|---|---|
| 856292 | 6/1940 | France | 221/231 |
| 395869 | 7/1933 | United Kingdom | 221/124 |

*Primary Examiner*—David H. Bollinger
*Attorney, Agent, or Firm*—Bill B. Berryhill

[57] ABSTRACT

Apparatus for storing one or more stacks of paper slips and for sequentially dispensing single slips from a stack as needed. The apparatus may include a protective housing having one or more compartments in which is disposed a flat plate on which a stack of paper slips may be placed. The plate is free to move upwardly or downwardly in the compartment and is biased upwardly. A roller assembly carried at one end of the housing for frictional engagement with the uppermost paper slip in a stack is selectively rotatable by a persons hand to dispense the uppermost slip through an opening in the end of the housing.

8 Claims, 2 Drawing Sheets

PAPER SLIP STORAGE AND DISPENSING APPARATUS

BACKGROUND OF THE INVENTION

1. Field of the Invention

The present invention pertains to apparatus for storing and dispensing slips of paper. More specifically, the present invention pertains to apparatus for storing one or more stacks of paper slips and for dispensing single slips from the stack as needed.

2. Description of the Prior Art

There are many situations in which paper items are used one at a time but which are stored in stacks prior to use. In some of these situations, it is partiacularly desirable that only one or two of the paper items be released or dispensed for use as needed. An example of such is the storage and dispensing of deposit and withdrawal slips, checks, drafts and the like at drive-in banking facilities. In such banking facilities, it is typical to provide a rectangular box or container in which one or more stacks of uniformly sized paper items (checks, deposit and withdrawal slips, etc.) are placed for access to the driver's side of an automobile. The containers are typically mounted on a pole and are usually opened at one end providing access to the driver of the automobile. There are several problems associated with this arrangement.

Since the bank paper container is open at one end, it is generally open to the elements (rain, wind, etc.). Even though the top of the container may be protected from such elements, wind and rain may blow through the open end causing the paper slips disposed in the container to be soaked or otherwise damaged and possibly blown out of the container. Since the slips are easily accessible through the open end of the container, users frequently remove more than they need and/or accidently remove additional slips from the container resulting in their dropping to the ground and litering the area with unslightly paper refuse. All these problems contribute to loss of expensive printed forms, loss of time in reloading the containers and increased maintenance around the facility. Improvements in such facilities are needed.

SUMMARY OF THE PRESENT INVENTION

In the present invention, apparatus is provided for storing one or more stacks of paper slips (particularly bank checks, deposit and withdrawal slips, etc.) and for sequentially dispensing single slips from a stack as needed. The apparatus provides a protective housing having one or more compartments therein and an opening at one end thereof. A flat plate or floor is disposed in each of the compartments on which a stack of paper slips may be placed. The plate is free to move upwardly or downwardly within the compartment in response to upwardly or downwardly directed forces thereon. Some form of biasing, such as springs, engages the plate to provide an upwardly directed force thereon. A roller assembly is carried by the housing for frictional engagement with the uppermost paper slip of a stack and is selectively rotatable by a user's hand to slide the uppermost slip from the stack for sequential dispensing of slips from the stack through the opening as needed. In a preferred embodiment, the roller assembly includes a cylindrical roller which rotates about an axis parallel to the surface of the plate and perpendicular to the direction in which the slips are to be dispensed through the opening.

A housing cover may be attached to the housing to protect the compartments and stack of slips therein from the elements and to prevent unauthorized tampering therewith. Locking means may be provided for this purpose. However, the housing cover may be moveable to a position in which the compartment is accessible for replenishing and stacking of slips therein. A weather shield may also be attached to the housing to cover the dispensing opening thereof but moveable to a position allowing access to the opening.

Thus, the apparatus of the present invention provides a means of storing a stack of paper items and protecting them from the elements while allowing them to be used as needed. An important object of the present invention is to allow such protected paper items to be sequentially dispensed from the stack of paper items as needed. The paper items are therefore not only protected from the elements but protected against waste, tampering, littering and the like. Many other objects and advantages of the invention will be apparent from reading the description which follows in conjunction with the accompanying drawings.

DESCRIPTION OF A PREFERRED EMBODIMENT

Figure 1:
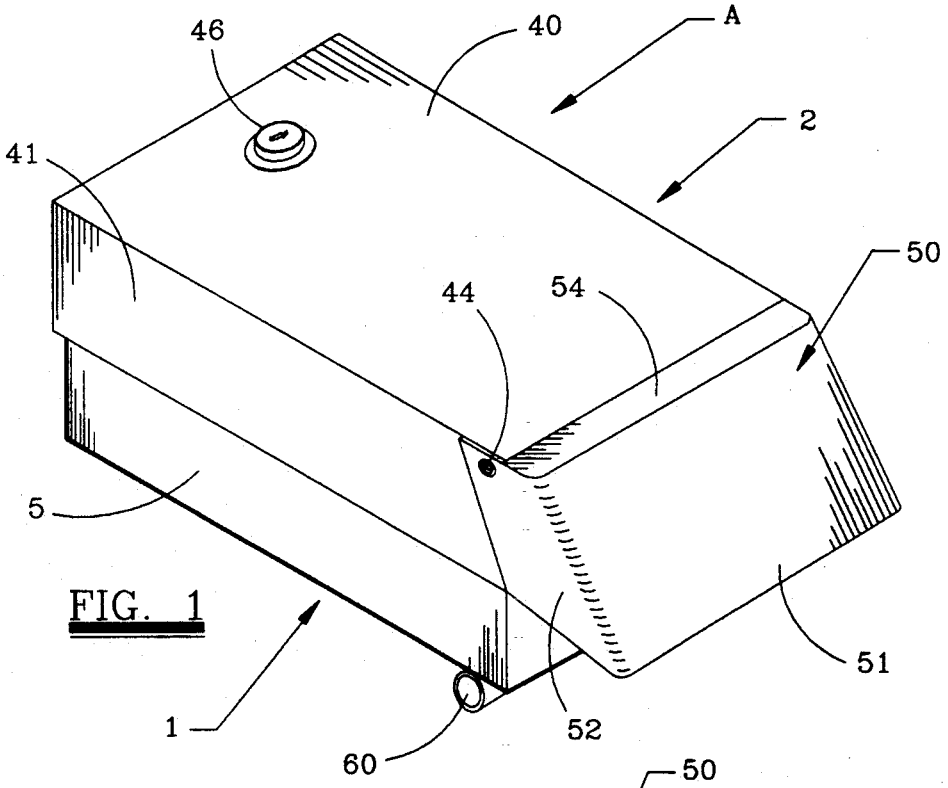
FIG. 1 is a perspective view of paper item storage and dispensing apparatus, according to a preferred embodiment of the invention.

Referring now to the drawings, there is shown apparatus A for storing stacks of paper items and for sequentially dispensing single paper items from the stack as needed. The exemplary embodiment depicted in the drawings is typical of one which would be built for two stacks of paper items such as deposit and withdrawal slips, drafts, etc. which would normally be supplied at a drive-in banking facility. Of course, the apparatus A could be made for one, two or more stacks of such paper items, the one shown being for descriptive purposes only.

The apparatus A includes a box-like housing 1 and a housing cover 2. The housing 1 has a bottom 4, side walls 5 and 6, rear wall 7 and front wall 8. The front wall 8 is somewhat shorter in height leaving an opening at 9 at one end of the housing. In the particular embodiment shown, an intermediate wall 10 and horizontal plate 11 define a small compartment at the rear of the container 1.

In the exemplary embodiment, the housing 1 is divided into two rectangular compartments 12 and 13 by a vertical compartment divider 14. Disposed in each of the compartments 12, 13 is a flat plate or floor 15, 16, respectively, on which may be placed a stack of paper items 17 such as the previously mentioned bank forms of deposit and withdrawal slips, drafts, etc. To accommodate forms of different widths and lengths, spacers such as 5*a*, 6*a*, 10*a*, 10*b*, 14*a*, 14*b*, may be provided. (See FIG's 3 and 4.) The plates 15 and 16 are free to move upwardly or downwardly within the compartments 12, 13 in response to upwardly or downwardly directed forces thereon. Biasing means, such as springs 20, 21, 22, 23 engage the underneath sides of these plates 15, 16 providing an upwardly directed force thereon. However, upward movement of the plates 15, 16 and the stacks of paper items 17, 18 thereon is limited by engagement with a horizontal stop 24 and rollers 30, 31 which will be described in greater detail hereafter. The stop 24 may be formed from a piece of angular stock, the vertical portion of which may be attached to intermediate wall 10 in any suitable fashion.

Figure 2:
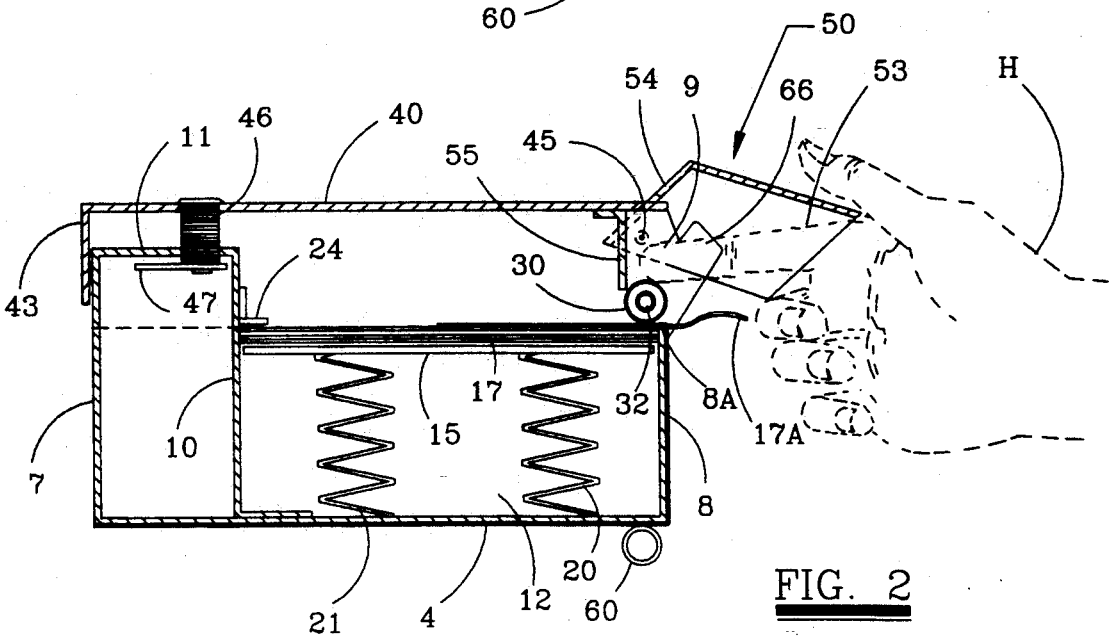
FIG. 2 is a side elevation view, in section, of the paper storage and dispensing apparatus of the present invention.
Figure 3:
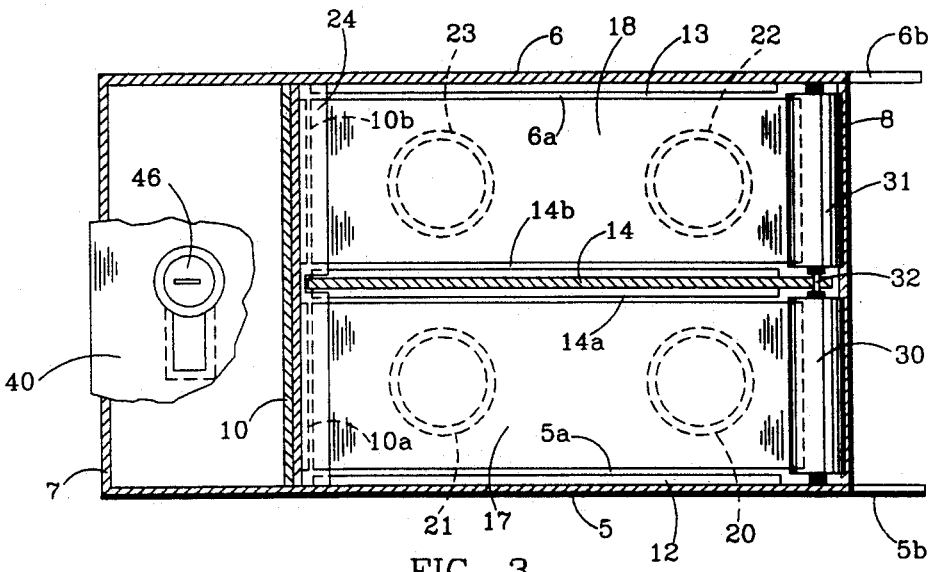
FIG. 3 is a plan view, partially in section, and with a portion of the housing cover thereof removed, of the paper storage and dispensing apparatus, according to a preferred embodiment of the invention.
Figure 4:
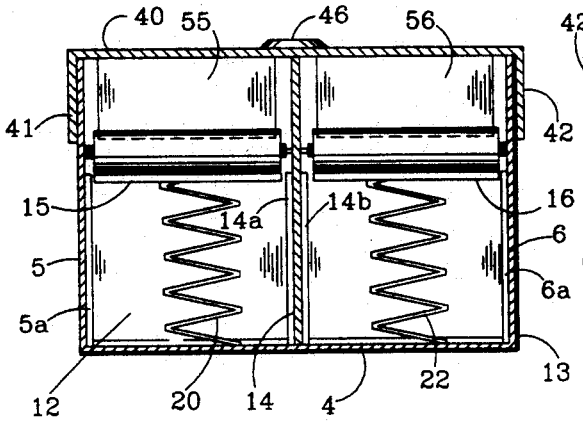
FIG. 4 is an in view, partially sectioned, of the paper storage and dispensing apparatus of the present invention.

The cylindrical rollers 30, 31 are mounted on a horizontal axle 32 for rotation about an axis which is parallel to the surface of the flat plates 15, 16 and perpendicular to the direction in which individual slips of paper from the paper stack 17 and 18 are to be dispensed through the opening 9. The axle 32 may be supported at its opposite ends in holes provided in the housing side walls 5 and 6 and if desired may also be supported by engagement with the compartment divider wall 14. The cylindrical rollers 30 and 31 may be made from a number of materials in a number of ways. For example, an outer clinder of rubber may be mounted on a inner drum cylinder. In any event, the rollers 30, 31 engage one end of the uppermost slip of paper, on its corresponding stack of paper item 17, 18 in frictional engagement therewith. As illustrated, the roller is at least partially recessed within the opening 9 so that it is at least partially protected from the elements. The rollers 30 and 31 are engageable by the fingers of a user through the opening 9 for rotation in the direction of the arrows as shown in FIG. 2, so that the uppermost slip, e.g. slip 17*a*, slides off the stack and through the opening 9 where it may be grasped by the user's hand H and removed from the apparatus A. The upper edge of front wall 8 may be beveled (see 8*a* in FIG. 2) to assist in dispensing.

Figure 5:
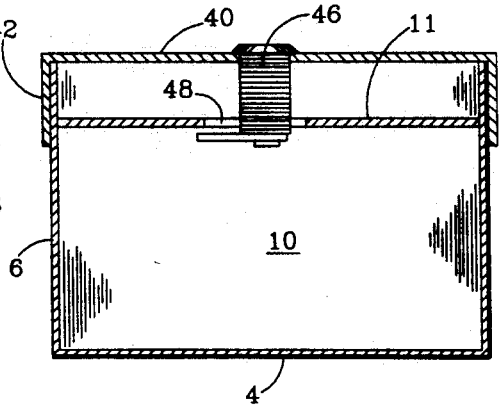
FIG. 5 is a view of the opposite end of the paper storage and dispensing apparatus, according to a preferred embodiment of the invention.

The apparatus A would normally be installed on the upper end of a support base or column (not shown) and exposed to outdoor elements. For this reason, the housing cover 2 is provided. The housing cover 2 may be made with a top 40, side walls 41, 42 and a rear wall 43. It is preferably connected to the side walls 5, 6 of the housing 1 by pivot connections 44, 45 so that the housing cover 2 may be pivoted forward (toward hand H as in FIG. 2) to provide access to the compartments 12, 13 for replenishing the stacks of paper items 17, 18 therein. The housing cover 2 may also be provided with a locking device 46 which is provided with an element 47 which cooperates with a hole or slot (See 48 in FIG. 5) in the horizontal wall 11 for movement between locked and unlocked positions. Thus, the housing cover 2 may be locked in place to prevent unauthorized tampering with the paper materials stored therein.

In addition, a weather shield 50 may be attached to the housing cover 2 or the housing 1, perhaps by the same pivot connections 44, 45 for movement from a first position, as shown in FIG. 1, partially covering the opening 9 and a second position, such as illustrated in FIG. 2, allowing access to the opening 9. This weather shield 50 may be made in several ways. As shown, it has a tapered or slanted front 51 and side members 52, 53. In addition, a rear lip 54 may be provided to further protect from the elements. In fact, some type of seal may be provided along the lip 54 to seal against the housing cover 2 either or both of the closed and open positions. In addition, the side walls 5 and 6 of the housing 1 would be made with extensions 5*b* and 6*b* to provide stops to hold the housing cover in its slanted and partially closed position.

To further insure against unwanted tampering, barriers 55, 56 may be attached to the housing cover 2 slightly to the rear of rollers 30, 31. This prevents persons or insects from invading the interior of the housing 1 through opening 9 above the rollers 30, 31.

If desired, a pen holder 60 of some type may be attached to the housing 1 (see FIG's 1 and 2). Of course, other useful items could be attached to the housing 1.

As previously mentioned, the apparatus A would be installed on a post or some other type of support adjacent to the lane provided for a vehicle at a drive-in banking facility. The compartments 12, 13 would be loaded with stacks of appropriate paper items by unlocking the housing cover 2 and pivoting the housing cover 2 to an open position. After loading, the housing cover would be closed and locked in place by the lock device 46. A user would drive adjacent to the apparatus A, raise the protective shield 50 and rotate the appropriate roller 30, 31 with a finger of his hand H. The frictional engagement of the roller, e.g. roller 30, with the uppermost paper item 17*a* would cause the paper 17*a* to be partially dispensed from the housing 1 where it can be grasped by the hand H and removed from the apparatus A.

Thus, the present invention provides apparatus for storing one or more stacks of paper items for sequential dispensing of single items therefrom as needed. Waste from exposure to the elements and from indiscriminate removal of several items from the housing 1 is drastically reduced. The savings in banking forms and maintenance of the area may be substantially reduced.

The exemplary embodiment has been described for use with banking forms at a drive-in banking facility. However, the apparatus of the present invention may be used in any application where it is desired to store stacks of paper items for sequential dispensing and use thereof. In fact, while a single embodiment of the invention has been described herein, many variations thereof may be made without departing from the spirit of the invention. Accordingly, it is intended that the scope of the invention be limited only by the claims which follow.

I claim:

1. Apparatus for storing one or more stacks of paper slips and for sequentially dispensing single slips from a stack as needed, said apparatus comprising:

a protective housing having at least one compartment therein and an opening at one end thereof;

a flat plate horizontally disposed in said compartment and on which a stack of said paper slips may be placed, said plate being free to move upwardly or downwardly within said compartment in response to upwardly or downwardly directed forces thereon;

bias means engaging said plate to provide an upwardly directed force thereon;

roller means carried by said housing and at least partially recessed within said opening for frictional engagement with the uppermost paper slip of said stack at one end thereof, said roller means being selectively engageable and rotatable by a users hand through said opening to slide said uppermost slip from said stack for sequentially dispensing slips from said stack through said opening as needed; and a weather shield attached to said housing and moveable from a first position covering said opening therein to a second position allowing access to said opening by said users hand.

2. The apparatus of claim 1 in which said roller means comprises a cylindrical roller attached to said housing for rotation about an axis which is parallel to the surface of said flat plate and perpendicular to the direction in which said slips are to be dispensed through said opening.

3. The apparatus of claim 2 including barrier means across said opening above said roller allowing engagement and rotation of said roller by said users hand but preventing unauthorized intrusion into the interior of said housing therethrough.

4. The apparatus of claim 1 including stop means carried by said housing and engageable with the other end of said stack of paper slips to limit the upward movement of said flat plate and the stack of paper slips thereon to a horizontal level compatible with the level of said roller means.

5. The apparatus of claim 1 including a housing cover attached to said housing protecting said compartment and said stack of slips from the elements and preventing unauthorized tampering therewith, said housing cover being moveable from said protecting position to a position in which said compartment is accessible for replenishing said stock of slips therein.

6. The apparatus of claim 5 including locking means carried by said housing and housing cover for locking said housing cover in said protecting position.

7. The apparatus of claim 1 in which said housing has at least two of said compartments, said compartments being separated by a compartment dividing wall.

8. The apparatus of claim 1 in which said housing and said weather shield are provided with stop means to stop said weather shield at said first position when moving from said second position.

* * * * *